US008499711B2

(12) United States Patent
Strong et al.

(10) Patent No.: US 8,499,711 B2
(45) Date of Patent: Aug. 6, 2013

(54) TOWING ROPE FOR WATER SKIING

(76) Inventors: Jared Strong, San Diego, CA (US); Marco Schilling, El Cajon, CA (US)

( * ) Notice: Subject to any disclaimer, the term of this patent is extended or adjusted under 35 U.S.C. 154(b) by 261 days.

(21) Appl. No.: 13/015,460

(22) Filed: Jan. 27, 2011

(65) Prior Publication Data

US 2011/0179987 A1 Jul. 28, 2011

Related U.S. Application Data

(60) Provisional application No. 61/298,867, filed on Jan. 27, 2010.

(51) Int. Cl.
*B63B 21/56* (2006.01)
*B63B 35/85* (2006.01)

(52) U.S. Cl.
USPC ..... 114/253; 441/69

(58) Field of Classification Search
USPC ..... 114/253; 441/65, 68, 69, 70, 73; 440/33
See application file for complete search history.

(56) References Cited

U.S. PATENT DOCUMENTS 3,142,075 A * 7/1964 Hill ..... 441/73
4,606,728 A * 8/1986 Simpson ..... 441/66
4,947,777 A * 8/1990 Yoder ..... 114/221 R
5,009,183 A * 4/1991 Naypaver ..... 114/253
5,083,955 A * 1/1992 Echols ..... 441/65

* cited by examiner

*Primary Examiner* — Lars A Olson
*Assistant Examiner* — Anthony Wiest
(74) *Attorney, Agent, or Firm* — Donn K. Harms

(57) ABSTRACT

A tow rope for a water ski which provides a manner to communicate a majority of the force from a tow rope engaged to a boat directly to the water ski during deep water starts by a skier. The force is transferred to a handle held by the skiers hands once the skier has reached a substantially standing position and is on top of the water. A quick release is provided which will disconnect the tow rope should the skier activate it or fall.

14 Claims, 3 Drawing Sheets

TOWING ROPE FOR WATER SKIING

This application claims priority to U.S. Provisional Patent Application Ser. No. 61/298,867 filed on Jan. 27, 2010, which is incorporated herein in its entirety by reference.

BACKGROUND OF THE INVENTION

1. Field of the Invention

This invention relates generally to water skis. More particularly the disclosed device and method relate to an improved tow rope and ski engagement system which is configured to assist a user in a deep water start. Through the communication of a substantial portion of the force of towing, directly to the water ski, deep water starts are made considerably easier for both novice and experienced skiers.

2. Prior Art

Water skiing has been a popular boating sport for decades. In the sport of water skiing, participants may employ one or two skis depending on their skill level. For participants employing either configuration, an inherent problem exists. Consistently problematic to all skiers is the step of employing a boat with a trailing tow rope held by the skier, to pull the skier from a floating position in the water rearward of the boat. The skier with their body substantially submerged in the water, must be pulled forward at a sufficient speed to impart a lift to the ski, to allow the skier to achieve a hydroplaning position standing on the water ski. Once sufficient speed is generated to impart the lift to the ski, both skier and ski are propelled upon the water surface while being towed behind the speeding boat.

For participants employing a single ski, as opposed to two skis, additional difficulty is incurred during such deep water starts. While submerged to their chest or neck, with the ski engaged to their feet, the skier must hold the tip of the ski above the water's surface. Additionally, the skier must be able to endure the difficulty of retaining their grip on the tow rope handle, and concurrently their balance, as the considerable force of the moving boat is communicated to the handle of the rope during a take off. In this submerged position the skier is essentially an anchor until they are able to move forward at sufficient speed to impart sufficient lift, to ride on top of the water.

During such a deep water start, a substantial amount of force must be endured by the skier's grip on the handle to pull them forward to a hydroplaning speed. For heavy or large skiers, this force is multiplied since they offer more resistance while in the water, and they must reach a higher speed before they rise above the water.

One conventional method to assist a skier in getting into an upright standing position on the moving ski is to simply have the skier take off from shore while they are already standing on the ski and holding the rope with tension on the tow rope. While this shore-start, or pier-start, eliminates the duration of extreme force communicated to a submerged skier to reach a velocity sufficient to lift a skier from a floating position, it has other associated problems. First, if the shore-starting skier falls, they must be taken back to the shallow water on shore which is hazardous to both boat and propeller. Additionally, the force exerted on the shore-starting skiers arms and shoulders and hands can be extreme, especially if the rope is not initially taught. This excessive force can cause injury, since the boat generally starts moving before the tow rope is made taught.

Because of the difficulty of holding onto the tow rope during such starts, many novice skiers fail and many experienced skiers become exhausted from simply getting to the skiing position. Further, it is a waste of valuable water-time to continually return and retry to pull a skier after a previous attempt to launch, especially if there are others waiting to ski.

An example of prior art may be seen in U.S. Pat. No. 4,606,728 which notes the various problems inherent to a deep water start of a skier. As a remedy, this patent teaches a water ski aid in deep water starts in which a user is seated on an inflatable member. As noted, this allows the user to start in a position more favorable to attaining an upright skiing position prior to take off. However, this method involves the use of extraneous equipment.

As such, there is a continuing unmet need for a device and method which will provide assistance to a water skier attempting a deep water start so as to move from the floating starting position, to an upright standing position on the moving ski. Such a device should significantly reduce the amount of force imparted to the skier's hands and thereby make it easier for novice and experienced skiers to hold the tow rope during a deep water start. Such a device in communicating force directly to the ski will thereby allow the skier to concentrate on balancing rather than holding on to the handle. Still further, such a device should be configured for use with the current installed base of conventionally employed tow ropes and ski boats to encourage widespread use. Finally, such a device should provide for an automatic release from the towing boat, should the skier fall or fail to negotiate the positioning change from floating to standing during a deep water or other start.

In this respect, before explaining at least one embodiment of the improved ski tow rope apparatus and method herein in detail, it is to be understood that the invention is not limited in its application to the details of construction and to the arrangement of the components set forth in the following description or illustrated in the drawings nor the steps and components outlined in the specification. The invention is capable of other embodiments and of being practiced and carried out in various ways as those skilled in the art will readily and immediately ascertain upon being educated by reading this application. Also, it is to be understood that the phraseology and terminology employed herein are for the purpose of description and should not be regarded as limiting.

As such, those skilled in the art will appreciate that the conception upon which this disclosure is based may readily be utilized as a basis for designing other methods and systems for carrying out the several purposes of the present invention which is a significant improvement to conventionally employed water skiing tow ropes and skis. It is important, therefore, that the claims be regarded as including such equivalent construction insofar as they do not depart from the spirit and scope of the present invention.

SUMMARY OF THE INVENTION

The device and method herein provides a solution to the above noted shortcomings in the prior art of tow ropes and the extreme force which must conventionally be endured by water skiers during deep water and other starts. The device and method provide a user with a means to directly communicate the substantial force of the tow rope which is communicated from the moving boat, directly to the water-ski. This removes the need for the skier to hold the handle and resist such a high force with only their hands during the initial act of moving from deep water or a nonmoving position to a standing position on a forward-moving water ski. In doing so, the device will enable novices to more easily learn to ski, and will prevent exhaustion for experienced skiers especially those who might be heavier.

As disclosed, the device includes a docking component configured for a removable direct attachment of a tow rope to the water ski. The tow rope employs a handle communicating with a main tow line, a split line communicating from the main tow line having an engaging end, and preferably a safety release line adapted to disengage the rope from the ski. This combination of components is employed while the skier is confronted with a deep water start during waterskiing.

In such a conventional deep water start, while the skier is floating in the water, they use their hands to grip and hold onto the handle which is communicating with rope with the main line of the tow rope which leads from the handle to an attachment point with the main line which has an opposite or distal end which engages with the towing boat.

The split line also leads from a main attachment point with the main line of the tow rope to an engagement end. The engagement end of the split line is configured for a removable engagement directly to the ski itself. This removable engagement is provided by a docking component on the ski adapted to engage a docking member on the two respective ends of the two portions of the split line. The two portions of the split line are engaged to respective ends of the docking member so as to extend at an angle such that they maintain a position positioned on each side of the ski when the skier is submerged and rising from the water. The docking member is adapted for removable engagement when placed into the docking station from a direction substantially perpendicular to the planar top surface of the ski. This allows the force of the tow rope to be imparted to the docking station yet allows for quick insertion and removal of the docking member if pulled away from the ski at a perpendicular direction.

The docking component may be engaged with the ski using a means of engagement adapted to the task to position it just forward of the front boot which provides a removable engagement to the foot of the skier with the ski. This docking component in the mode of the device for a single ski use, in combination with the docking member, maintains an angled widening gap between the two portions of the split line communicating between the docking member and the main line. This gap provides a means to maintain both portions of the split line adjacent to the outside edges of the front end of the ski during a start.

The length of the two portions of the split line are sufficiently short so as to allow for a sufficient amount of slack to be maintained in the handle line communicating between the main line and the engagement point, during a take off. This allows the force communicated by the moving boat to be directly communicated to the ski, and not to the hands of the skier who may concentrate on balancing and getting up.

In use, as the towing vessel takes off and moves away from the skier, and communicates force through the tow rope to the skier so they may reach a speed to impart lift to the ski to raise both from the water, the docking component and docking member are configured to impart the force to the ski for a period of time and then allow the docking member to slip out of its engagement with the docking component. Upon this disengagement, the tension from the force of the boat communicated through the tow rope is redirected to the handle line and handle which is in the user's grip. However, by this time the skier has reached sufficient velocity that the torque pulling the handle is minimal.

With the substantial initial force from the boat movement being directed to both portions of the split line to the board-mounted docking component, much less grip strength is required by the skier to rise from deep water or other starts. Thus, be they a novice or experienced, they are no longer fatigued during the take off process and can maintain their strength and grip and balance much longer once the upright skiing position is reached. Further, for user's heretofore incapable of holding the handle during a take off from deep water, which is an especially vexing problem for large or heavy skiers, the disclosed device allows such users to rise to the riding position by communicating force to the ski rather then their hands.

Safety is enhanced by the device should a user fail to completely reach the upright skiing position, causing a fall during the take off process while both the rope and ski are being pulled by great force. To ensure that the engagement member does not maintain its engagement at the docking component on the ski (causing the user to be dragged behind the boat), a quick release component is provided between both the handle line and the split line and the main line of the tow rope. This quick release component is engaged to a safety line which follows a path to a ring or handle positioned adjacent to the handle held by the skier. In case of a fall, or if the user gets tired during skiing, the user may simply tug the safety line which translates a collar on the quick release causing a release of the tow rope from both the split line and handle line. This allows the user an active means to release the force of the boat from the ski should the passive release of the docking member from the docking component fail.

With respect to the above description, it is to be understood that the invention is not limited in its application to the details of operation of aiding a user to water ski, or a quick release of a skier from a tow rope, nor the arrangement of the components or steps in the method set forth above or in the following descriptions or in the illustrations in the drawings. The various methods of implementation and operation of the disclosed method and device used to aid in water skiing herein, are capable of other embodiments and of being practiced and carried out in various ways which will be obvious to those skilled in the art once they review this disclosure.

Therefor, those skilled in the art will appreciate that the conception upon which this disclosure is based may readily be utilized as a basis for designing similar water ski devices or methods for carrying out the several purposes of the present invention. Therefor, the objects and claims following herein should be regarded as including such equivalent constructions, steps, and methodology insofar as they do not depart from the spirit and scope of the present invention.

It is an object of this invention to assist a towed water skier to achieve an upright skiing position starting from a stagnate floating position.

It is another object of this invention to communicate the initial force or torque communicated to a skier by a boat on the tow rope during a take off, away from the users grip, and directly to the ski itself to thereby reduce the fatigue caused by high forces required to lift a water skier out of the water.

It is yet another object of this invention to allow the user to safely release themselves and the ski from the towing rope in the case of a fall, or to keep from being dragged behind the boat.

Yet an additional object of the invention is to provide a device which will allow skiers, heretofore incapable of holding the tow rope handle for sufficient time during deep water starts, to move from submersion to riding the ski, a means to do so.

These together with other objects and advantages of the improved engagement of a ski rope to a ski which will become subsequently apparent to those skilled in the art, reside in the details of the construction and method herein as more fully hereinafter described and claimed, reference being had to the accompanying drawings forming a part thereof, wherein like numerals refer to like parts throughout.

DETAILED DESCRIPTION OF THE PREFERRED

Embodiments of the Invention

Figure 1:
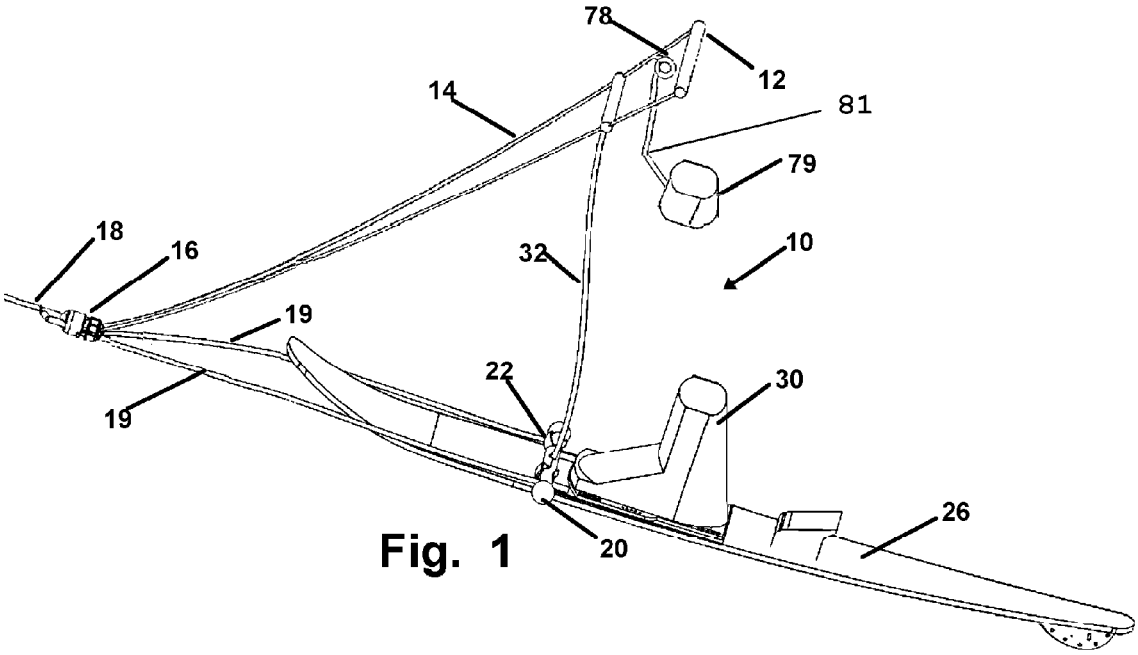
FIG. 1 is a perspective view of one mode of the invention showing the handle on a handle line, the split line engaged to a docking member, and a quick release at a common attachment point for both.
Figure 2:
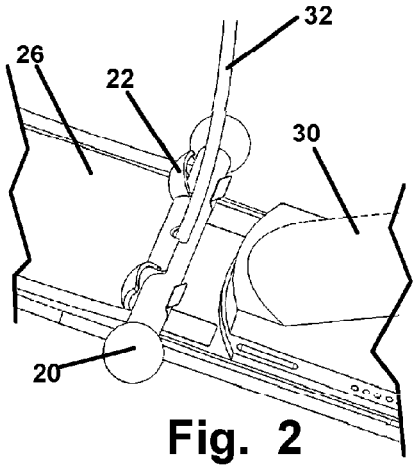
FIG. 2 depicts the biased engagement of the docking member with the docking component which is engaged to the top planar surface of a water ski.

Now referring to drawings in FIGS. 1-10, wherein similar components are identified by like reference numerals, there is seen in FIG. 1 a perspective view of one mode of the device 10. As shown, the handle 12 is engaged to the proximal end of a handle rope 14 which engages the quick release component 16 which is engaged to the tow rope main line 18 communicating between the quick release component 16 and a boat.

Also engaging at a first end with the quick release component 16 is the split line 19, or docking rope, which is engaged to a docking member 20 at both distal ends of both two portions of the split line 19. It is to be understood that the terms 'split line' and 'docking rope' may be used interchangeably to represent the split line 19 shown in the figures. The docking member 20 is removably engageable with a docking component 22 which is engaged to the top surface of a water ski 26 just forward of the rubber boot 30 adapted to hold a user's foot to the ski 26. The opposite ends of both portions of the split line 19, are attached to the quick release component 16 using means of attachment thereto such as a knot through an aperture in the quick release component 16.

A release line 32 is engaged to and between the docking member 20 and the handle rope 14. The release line 32 is of a length to allow the user to hold onto the handle 12 while in the crouched position of a skier in a deep water start. Once the skier rises to substantially a standing position, the length of the release line 32 causes an upward force, substantially perpendicular in direction to the plane of the top surface of the ski 26, to be exerted on the docking member 20. This force is sufficient to pull the docking member 20 from its biased engagement within the docking component 22 and the inwardly based spring members 23 shown. Thereafter the force from the tow rope is communicated to the handle 12 rather than the docking component 22.

Figure 3:
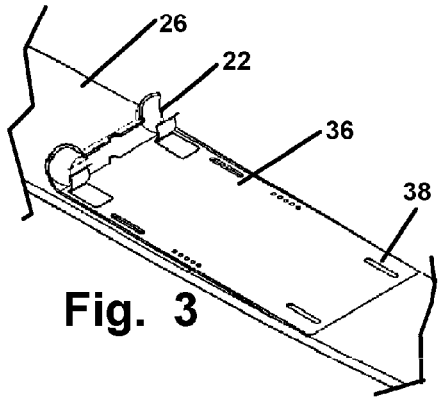
FIG. 3 depicts one mode of a mounting plate adapted to engage upon the top surface of a ski underneath the conventional rubber boot.
Figure 6:
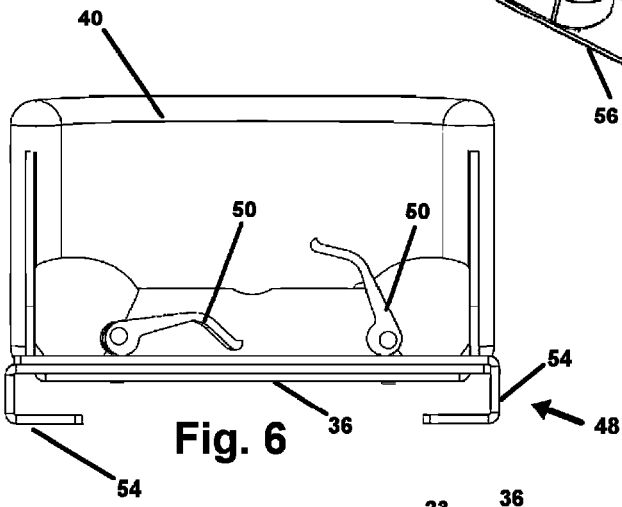
FIG. 6 depicts and end view of the device of FIG. 4 showing the means for clamping the device upon a ski activated by handles having a cam surface.
Figure 5:
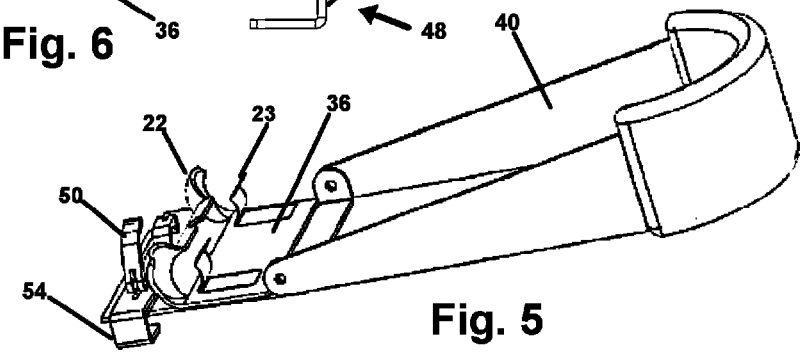
FIG. 5 depicts the mounting plate and components for engagement of the device of FIG. 4.

FIG. 3 shows a mode of engagement of the docking component 22 with the ski 26 as would be typical with a ski 26 having a removable boot 30. A mounting plate 36 is positioned underneath the boot 30 and the screws, or other suitable fastener, employed to hold the boot 30 are communicated through slots 38 in the mounting plate 36. Of course those skilled in the art will realize that the means of engagement to the ski 26 of FIG. 3 and of FIG. 5-6, are but two ways to engage the docking component 22 to a water ski 26. As such, any means of engagement of the docking component 22 to a ski 26 as would occur to those skilled in the art, such as a suitable fastener, is anticipated within the scope of this application.

Figure 4:
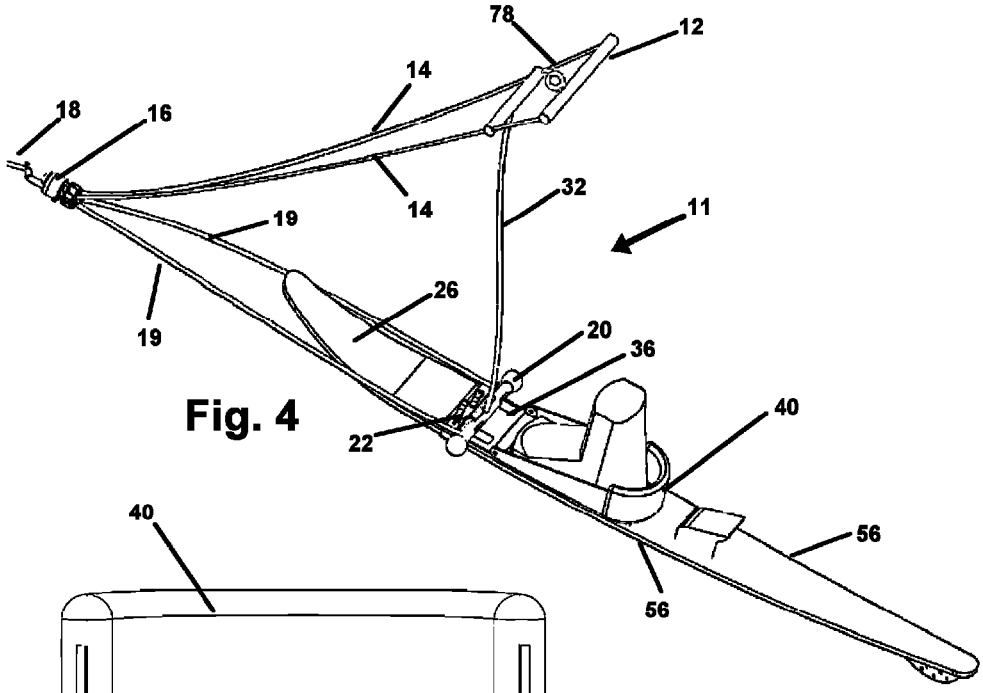
FIG. 4 depicts a perspective view of another mode of the device herein configured for engagement to skis where the boot may not be removed.

FIG. 4 shows a perspective view of another mode of the device 11 herein configured for engagement to skis 26 where the boot 30 may not be removable. In this mode of the device 11 the same configuration and operation of the docking member 20 and docking component 22 are employed. The means of engagement of the docking component 22 to the ski 26 is provided by a clamping component shown in FIG. 6. Additionally, provided to communicate the force of the tow rope to the foot of the skier in the boot 30 is a collar 40 which communicates from the rear of the mounting plate 36 and around the boot 30 engaged to the ski 26.

As shown in FIG. 6, the device of FIGS. 4-6 can be portable and engaged quickly to a ski 26 where the boot 30 is not removable or should there be no desire to remove the boot 30 to mount the docking component 22. A clamping component 48 employs two levers 50 to translate a pair of opposing hook portions 54 toward the outside edges 56 of a ski 26 thereby engaging the docking component 22 to the ski 26. The collar 40 communicates the axial force of the tow rope on the docking component 22 to the rear of the boot 30 and foot of the user thereby minimizing the need for screws or other means to engage the docking component 22 to the ski 26.

Figure 7:
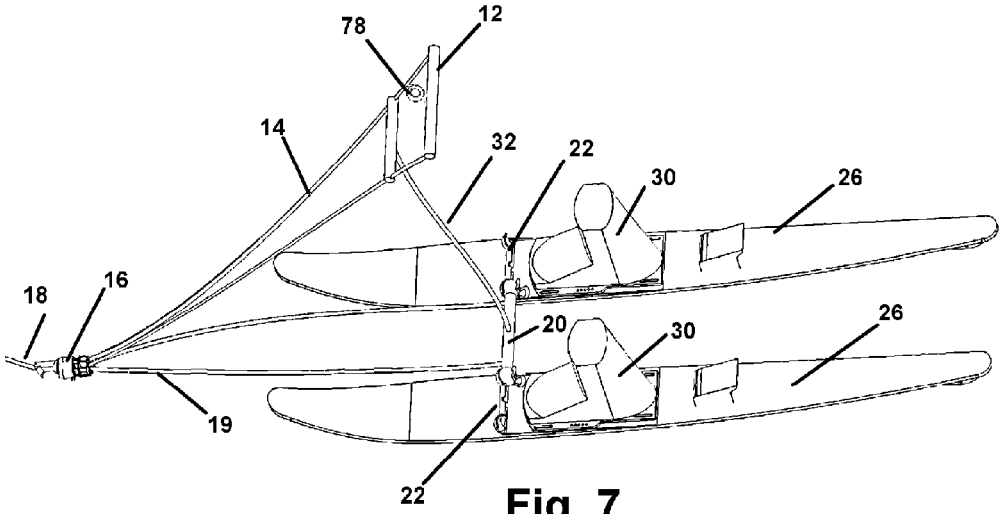
FIG. 7 shows another mode of the device adapted for engagement of the docking member concurrently with two skis having docking components therefor.

Another mode of the device 10 is shown in FIG. 7 which is adapted for engagement to a pair of skis 26. In this mode of the device 10 the docking member 20 engages individual docking components 22 mounted to each ski 26. Operation is the same as the other modes noted earlier.

Figure 8:
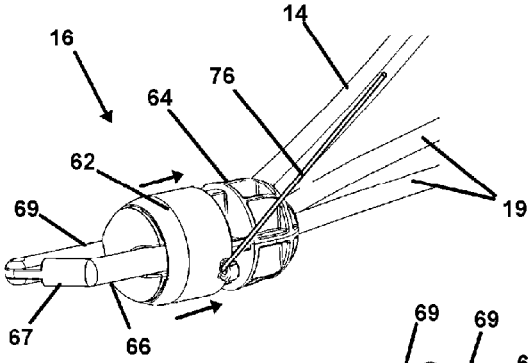
FIG. 8 depicts the quick release device configured for engagement on a first end with the main line of a tow rope leading to the boat, and on a second end with both the split line and handle line.
Figure 10:
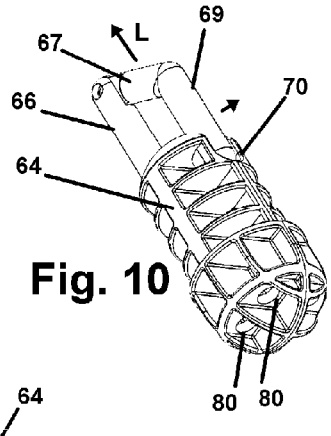
FIG. 10 shows the quick release of FIG. 9 without the locking collar and depicts a direction of the force or load "L" of the main line leading to a tow boat causing rotation of the angled portion of a hinged ring and an immediate release of the quick release from a taught tow rope.
Figure 9:
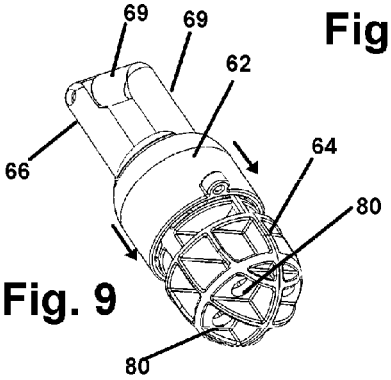
FIG. 9 depicts a translating collar and the direction of translation causing a release of the quick release from a tow rope.

FIGS. 8-10 depict the novel quick release component 16 which interfaces between the main line 18 of the tow rope, and the handle rope 14 and the split line 19. The quick release component 16 is configured to provide an immediate separation of the tow rope main line 18 from both the handle rope 14 and the split line 19. As shown in FIGS. 8 and 9, a translating collar 62 is situated about the body 64 of the quick release component 16. Translation of the collar 62 moves it away from the ring 66 which engages with the main line 18 of the tow rope leading to the towing boat. Once translated to away from the ring 66 the distal end of the hinged ring 66 is free to rotate away from the body 64 and cause the main line 18 to fall out of engagement with the ring 66. Rotation of the hinged components forming the ring 66 is encouraged by the angled middle portion 67 of the ring and the shorter distal portion 69 which engages with a slot 70 in the body 64. Because the main line 18 is under a force or load "L" during use, should the collar 62 be translated away from the ring end of the body 64, the slot 70 is uncovered. The angled middle portion 67 of the ring 66 is pulled by the main line 18 causing the shorter distal portion 69 to immediately separate from the body 64 and release the main line 18 from the engaged split line 19 and handle rope 14.

The user is afforded with a release line 76 which communicates in a conduit to a ring 78 positioned adjacent to the handle 12 or it may be also engaged to a tether 81 and cuff 79 or other means to attach to the user's body while riding. A quick tug of the ring 78 will translate the safety line 76 causing a translation of the collar 62 away from the ring 66 to expose the slot 70 and allow the distal portion 69 to release from the body 64 to release the main line 18. If the cuff 79 or other means of attachment to the body is employed, if the user falls, it will activate the release also. While the device 10 herein will function without the quick release component 16 and such is anticipated, the quick release component 16 does provide for safety of the rider and is preferred. It also provides a plurality of apertures 80 in the body 64 for engaging both the split lines 19 and the handle line rope 14 thereto.

While all of the fundamental characteristics and features of the towing rope device herein have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A tow rope for employment in combination with a water ski comprising:

a handle;

a handle rope engaged at a first end to said handle and extending to a second end;

said handle configured for a gripping by a user riding said water ski;

a docking member, said docking member configured for a removable engagement with a docking component which is positioned on a top surface of said water ski;

said docking component comprising a base plate engageable to said top surface of said ski, a pair of sidewalls rising from said baseplate, and a space between said sidewalls configured for frictional engagement with said docking member;

a docking rope engaged at a first end to said docking member and extending to a distal end;

means to engage said distal end of said docking rope and said second end of said handle rope to one end of a tow rope main line configured to attach to a boat;

said docking member disengageable from said docking component when moved in a substantially vertical direction relative to said top surface of said ski;

a release line communicating between said handle rope and said docking member; and said release line providing means to exert force upon said docking member to move in said vertical direction when a user of said ski rises from a crouched position to a substantially standing position while riding said ski, whereby force from said tow rope main line engaged to said boat during a start is communicated primarily to said ski by said docking member until said user moves from a said crouched position during said start to said substantially standing position whereafter said force is communicated solely to one or both hands of said user.

2. The tow rope of claim 1 additionally comprising:

at least one of said sidewalls formed of resilient material;

said space between said sidewalls being smaller than a diameter of said docking member; and said sidewalls exerting a bias against said docking member when engaged within said docking component.

3. The tow rope of claim 1 wherein said means to engage said distal end of said docking rope and said second end of said handle rope to one end of a tow rope main line comprises:

a release component having a body;

a first end of said body having at least one aperture therein sized for engagement with said distal end of said docking rope and said second end of said handle rope;

a ring, said ring rotationally engaged to said body at an opposite end from said first end;

said ring configured for an engagement of said tow rope main line;

said ring moveable between a closed position wherein said tow rope main line is held thereon, to an open position wherein said tow rope main line will slide from said ring when said force is being communicated from said boat to said ski; and means for said user to cause said ring to move to said open position, whereby said tow rope main line can be released from said body ending communication of said force to said ski.

4. The tow rope of claim 2 wherein said means to engage said distal end of said docking rope and said second end of said handle rope to one end of a tow rope main line comprises:

a release component having a body;

a first end of said body having at least one aperture therein sized for engagement with said distal end of said docking rope and said second end of said handle rope;

a ring, said ring rotationally engaged to said body at an opposite end from said first end;

said ring configured for an engagement of said tow rope main line;

said ring moveable between a closed position wherein said tow rope main line is held thereon, to an open position wherein said tow rope main line will slide from said ring when said force is being communicated from said boat to said ski; and means for said user to cause said ring to move to said open position, whereby said tow rope main line can be released from said body ending communication of said force to said ski.

5. The tow rope of claim 3 wherein said means for said user to cause said ring to move to said open position comprises:

a collar translatably engaged upon an exterior circumference of said body;

said collar having a first position adjacent to said ring and a second position adjacent to said first end of said body;

said collar in said first position locking said ring in said closed position;

said collar in said second position allowing said ring to move to said open position; and a tether engaged at a first end to said collar and having a second end positioned adjacent to said handle, whereby a tug on said tether causes a translation of said collar to said second position.

6. The tow rope of claim 4 wherein said means for said user to cause said ring to move to said open position comprises:

a collar translatably engaged upon an exterior circumference of said body;

said collar having a first position adjacent to said ring and a second position adjacent to said first end of said body;

said collar in said first position locking said ring in said closed position;

said collar in said second position allowing said ring to move to said open position; and a tether engaged at a first end to said collar and having a second end positioned adjacent to said handle, whereby a tug on said tether causes a translation of said collar to said second position.

7. The tow rope of claim 5 additionally comprising:

means to attach said second end of said tether to the person of said user, whereby said tug is exerted upon said tether should said user fall during a ride on said ski.

8. The tow rope of claim 6 additionally comprising:

means to attach said second end of said tether to the person of said user, whereby said tug is exerted upon said tether should said user fall during a ride on said ski.

9. The tow rope of claim 5 additionally comprising:

said ring formed of at least three rotatably engaged members;

a first member of said engaged members being longer than the other two of said members;

a second member of said engaged members extending parallel to said first member;

a third member rotationally engaged at an angle extending between said first member at one end and said second member at an opposite end; and said force communicated to said third member by said tow rope main line engaged thereon causing said second member to disengage from a slot in said body when said collar is moved to said second position.

10. The tow rope of claim 6 additionally comprising:

said ring formed of at least three rotatably engaged members;

a first member of said engaged members being longer than the other two of said members;

a second member of said engaged members extending parallel to said first member;

a third member rotationally engaged at an angle extending between said first member at one end and said second member at an opposite end; and said force communicated to said third member by said tow rope main line engaged thereon causing said second member to disengage from a slot in said body when said collar is moved to said second position.

11. The tow rope of claim 1 additionally comprising:

said docking component being held positioned on said top surface of said water ski using fasteners communicating into said top surface of said water ski.

12. The tow rope of claim 1 additionally comprising:

said docking component being held positioned on said top surface of said water ski using a clamping component with a pair of opposing hooked portions communicating around side edges of said water ski.

13. The tow rope of claim 1 additionally comprising:

a collar communicating from said docking component around a boot positioned on said top surface of said water ski;

said boot configured to engage a foot of said user during operative use of said water ski; and said collar providing means to communicate a portion of said force to said boot and said foot.

14. The tow rope of claim 12 additionally comprising:

a collar communicating from said docking component around a boot positioned on said top surface of said water ski;

said boot configured to engage a foot of said user during operative use of said water ski; and said collar providing means to communicate a portion of said force to said boot and said foot.

* * * * *